United States Patent [19]

Norén

[11] 4,218,052

[45] Aug. 19, 1980

[54] APPARATUS FOR FOLDING A SHEET OF MATERIAL AN ANGLE OF 180°

[75] Inventor: Arne I. Norén, Stockhlom, Sweden

[73] Assignee: Nils Gustav Carlsson, Älvsjö, Sweden, part interest

[21] Appl. No.: 952,083

[22] Filed: Oct. 17, 1978

[30] Foreign Application Priority Data

Oct. 27, 1977 [SE] Sweden ..... 7712117

[51] Int. Cl.[2] ..... B65H 45/16

[52] U.S. Cl. ..... 270/71; 270/76

[58] Field of Search ..... 270/70-72, 270/74-75, 76-78; 93/84 R

[56] References Cited

U.S. PATENT DOCUMENTS

| | | | |
|---|---|---|---|
| 512,944 | 1/1894 | Carr | 270/72 |
| 729,597 | 6/1903 | Johnston | 270/71 |
| 1,787,945 | 1/1931 | Lang | 270/76 |
| 3,540,722 | 11/1970 | Kuhni | 270/72 |

*Primary Examiner*—Edgar S. Burr

*Assistant Examiner*—A. Heinz

*Attorney, Agent, or Firm*—Burns, Doane, Swecker & Mathis

[57] ABSTRACT

An apparatus for folding a sheet of material, for example a newspaper, through an angle of 180° by conveying the material between a rotatable element provided with one or more blades and an element for receiving the material folded by said blade or blades. The element for receiving the material when folded by said blade or blades comprises two rollers (4, 5), which are moved at a speed corresponding to the conveying speed of the material or substantially corresponding to said speed. The two rollers (4, 5) are further arranged to be displaced in a circular arculate path, and the blade (8) is arranged to adopt a position between the rollers (4, 5) at a position (FIG. 4) of the rollers during the revolution. Said two rollers are coupled together and form together a circular arculate path, but with a blade (6) orientated through the axes of rotation of the rollers (4, 5) constantly adopting one and the same horizontal or vertical direction.

13 Claims, 12 Drawing Figures

APPARATUS FOR FOLDING A SHEET OF MATERIAL AN ANGLE OF 180°

FIELD OF THE PRESENT INVENTION

The present invention relates to an apparatus of such a construction that it enables a sheet of material to be folded through an angle of 180° by permitting, in a manner known per se, the sheet of material to be transported between a rotatable element provided with one or more blades, and an element of receiving the material as it is folded by said one or more blades.

Although the invention can be used to fold any suitable material through an angle of 180°, the following description will be made with reference to a newspaper or newsprint comprising a plurality of mutually adjacent pages to be folded. Folding is normally effected in the central portion of the material, i.e. the material is folded in half.

BRIEF DESCRIPTION OF THE PRIOR ART

A number of methods are known for folding such material as newspapers through an angle of 180°.

The first of these methods is mainly used in rotational printing presses for folding the web of paper printed therein.

The apparatus used in one of said methods is a so-called "bladed-folder" and comprises a rotatable cylinder having a folder-blade mounted thereon. The cylinder is arranged for rotation about its centre of rotation, although the blade is rotatably mounted immediately adjacent the cylindrical surface of said cylinder radially inwardly of said surface. The folder blade and the outer surface of the cylinder are able to rotate individually of one another, and the centre of rotation of the blade is located parallel with the centre of rotation of the cylinder. Rotation of the blade is guided by rotation of the cylinder in a manner such that the blade rotates two or three revolutions for each revolution of the cylinder. The lenght of the blade and the positioning of its centre of rotation are so selected that the blade moves externally on the cylindrical surface of the cylinder during part of a revolution of said blade. During this part of its rotation, the tip of the blade passes, at only one location during one rotation of the cylinder, a stationarily arranged but rotating pair of rolls in a manner such that the tip of said blade is passed in against and remains located in the tangential point of the pair of rollers, each of which rotates in a mutually oppositely direction of movement. The material (the newspaper) is forced in between the pair of rollers by said blade tip and is folded between said rollers, through 180° and is transported away between said rollers.

The second of the known methods is also mainly used with rotational printing presses and is generally designated the "flap-fold method".

This method utilizes two mutually adjacent rotatable cylinders one of which is provided with a blade or knife extending along the cylindrical surface of said cylinder, while the cylindrical surface of the other of said cylinders is provided with a groove or slot. Rotation of these cylinders is selected in a manner such that a blade or knife passes into the groove at each revolution.

The groove is also arranged to cooperate with a flap on one side of the cylinder, this flap normally being guided or controlled by the rotary movement of the cylinder in a manner such that the flap is able to open, to receive the material to be folded, and to close to hold the material, and is then again opened to release the material. The cylinders are so positioned relative to one another that when the flap enters the groove with the sheet of material therebetween, the material is folded.

A third method should be mentioned, which can be used to advantage when the paper web is cut into separate pieces and when folding of thus separated points of the web is desired, even through the web may have been folded by one of the aforementioned folding methods. Folding of a divided or cut paper web is effected between two rollers which rotate in mutually opposite directions.

A folding knife or blade is arranged for reciprocating movement between the tangential point (point of contact) of the two rollers, the material being forced between the rollers by the blade or knife, thereby to fold said material.

It should be noted that the sheet to be folded must be separated from the paper web prior to the folding operation and, furthermore must be stationary immediately before folding is commenced.

Each of the aforedescribed methods affords a number of advantages in relation to one another, but also present a number of disadvantages.

One disadvantage with the method utilizing a bladed-folding device is that the position of the fold is displaced longitudinally within certain speed limits. The bladed, folding device, however, is able to fold relatively thick materials.

The "flap-folding method" has the advantage that the fold is satisfactorily positioned relative to the longitudinal extension of the material, irrespective of the speed, but thick materials cannot be folded satisfactorily by this method.

The third method described above, in which the material must be separated from the web of material before being folded and which material must be stationary prior to commencing a folding operation, has a restricted folding speed, due to the up and down movement of the knife, which results in a slowing down of the production capacity of other machines in the production line.

OBJECTS OF THE PRESENT INVENTION

An object of the present invention is to provide an apparatus in which the aforementioned disadvantages are eliminated, whilst retaining the advantages afforded by the previously known apparatus.

Thus, an object of the present invention is to provide a folding apparatus which, (a) enables the fold line to constantly lie in the longitudinal direction of the paper web or sheet of material to be folded, irrespective of the speed, (b) enables thick material to be folded, (c) enables folding to be effected at high production rates.

In accordance with the present invention this has been made possible by causing the paper web and the folding-knife to move at the same speed as the receiving pair of rollers, which in turn has meant that construction is based on solely rotational movements. In this way, folding of the material can be carried out at high speeds, i.e. speeds which considerably exceeds the speed at which the aforedescribed third method can be carried out.

The main characterizing features of an apparatus according to the present invention are disclosed in the characterizing clause of the accompanying claim one.

BRIEF DESCRIPTION OF THE ACCOMPANYING DRAWINGS

So that the invention will be more readily understood and further features thereof made apparent, an exemplary embodiment of the invention will now be described with reference to the accompanying schematic drawings, in which FIG. 1 is a side view of an apparatus according to the invention, showing the apparatus in a material receiving position, FIG. 2 illustrates the mutual position of the elements forming part of the apparatus subsequent to the material having been folded through 180° and caught by two mutually parallel rollers, FIG. 3 illustrates a position in which the material, folded through 180°, is passed to a depositing means, FIG. 4*a* and 4*b* illustrate on somewhat larger scale, the mutual relationship between the elements forming part of the apparatus at that moment when the blades caused to urge the material between the tangential point of the two rollers and at a fractionally later point of time, FIG. 5 is a vertical, longitudinal sectional view of one side part of the apparatus, and is a vertical section through said tangential point, FIG. 6 is a horizontal longitudinal sectional view of one side part of the apparatus, and is a horizontal section through said tangential point, FIG. 7 is a vertical view of the other side-part of the apparatus, FIG. 8 is a horizontal view of said other side-part of the apparatus, FIG. 9 is a side view of certain of the elements shown in FIG. 4, FIG. 10 illustrates certain of the elements shown in FIG. 5 in larger scale, and FIG. 11 illustrates in larger scale certain of the elements illustrated in FIG. 6.

DESCRIPTION OF A PREFERRED EMBODIMENT

Figure 1:
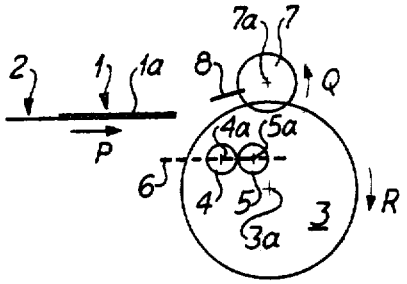
Figure 2:
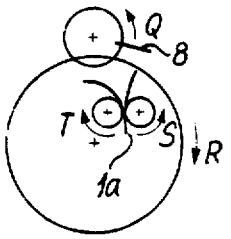

The manner in which the apparatus according to present invention folds a sheet of material, in the following description referred to as a newspaper, through an angle of 180° will be described with reference to FIGS. 1–4. The material 1 to be folded comprises a relatively thick newspaper and it is assumed that a variety of newspaper separated from each other are moved in the direction of the arrow "P" at a given distance apart. The speed at which the newspapers are conveyed corresponds to the production speed of the printing machine. The newspaper 1 is conveyed on a belt 2, not shown in detail in the Figure.

The illustrated apparatus according to the invention comprises two rotatable plates 3, 3' on which a pair of rollers 4 and 5 are mounted.

The axis 4*a* of rotation of the roller 4 and the axis 5*a* of the rotation of the roller 5 are both located in one and the same horizontal plane 6. A significant feature of the present invention is that the two rollers 4 and 5 are so connected together that the plane 6 through the axis 4*a*, 5*a*, of rotation of the rollers constantly occupies one and the same position relative to the horizontal or vertical plane.

In accordance with the invention, the plane 6 can be rotated around the horizontal plane illustrated in FIG. 1, as will be hereinafter described in more detail.

Arranged to co-operate with the two rollers 4 and 5, which form means for receiving the material to be folded, is a rotatable element 7 provided with one or more blades. For the sake of clarity the rotatable element 7 is shown to be provided with only one blade referenced 8. When the rotatable element is provided with two blades 8, the blades shall be positioned diametrically opposite one another and oriented in a manner such that an extension of respective blades would extend through the axis 7*a* of rotation of the rotatable element 7. In such a case there is required a further two rollers 4 and 5 positioned diametrically of the rotation centre 3*a* in the plate 3. There is nothing to prevent one blade 8 from being used for two or more pairs of rollers 4 and 5 symmetrically oriented along the plates 3 and 3'. The perpheral speed of the blade 8 shall coincide with or substantially coincide with the speed of the tangential point of the rollers 4 and 5 around the centre of rotation 3*a*.

In conjunction herewith, it will be understood that two or more blades can also be used for one pair of rollers 4 and 5 with the aforementioned conditions applied.

Figure 4A:
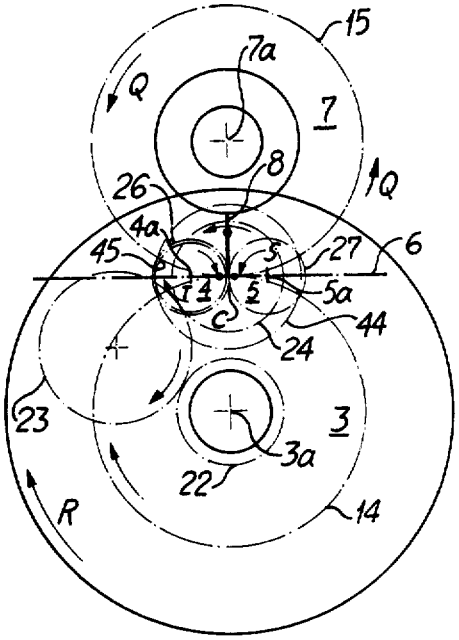
Figure 4B:
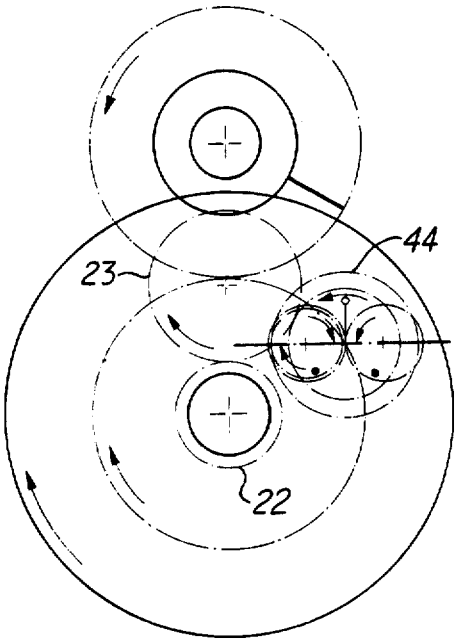
Figure 9:
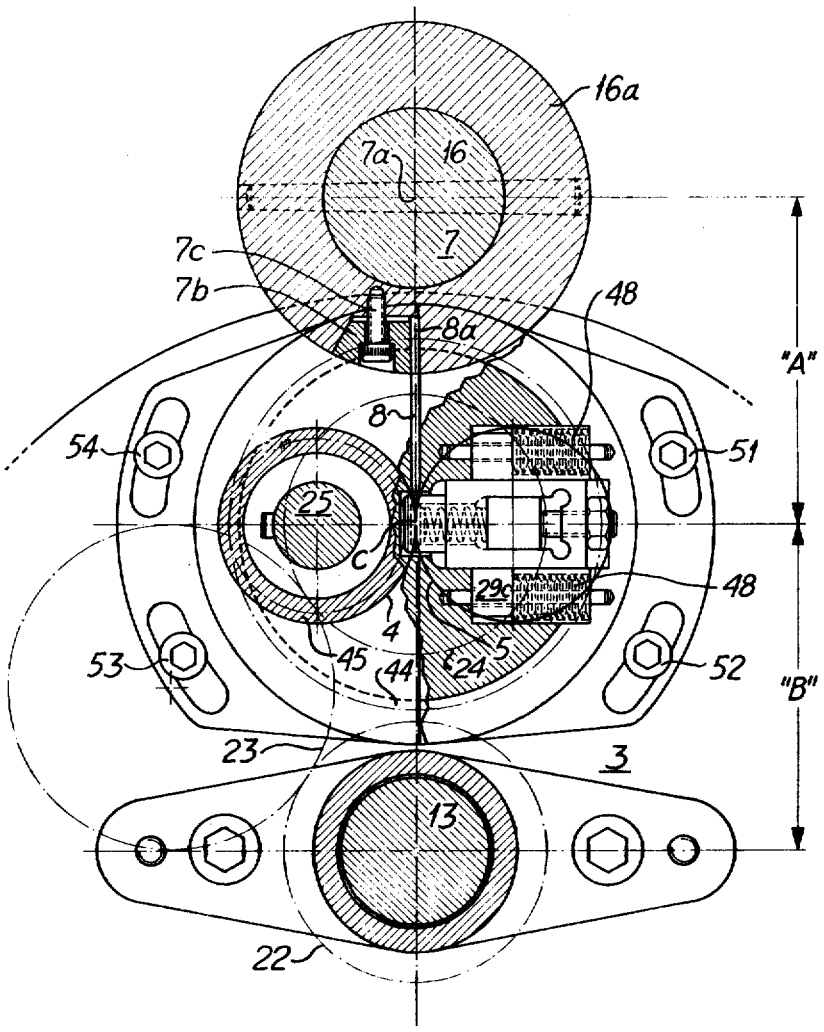

Thus, in a manner hereinafter described in more detail, the two rollers 4 and 5 are arranged to be displaced in a circular-arcuate path and the blade 8 is arranged to adopt a position between the rollers 4 and 5 at one terminal position of the rollers during one revolution. This position is illustrated in FIGS. 4 and 9. Subsequent to the blade 8 having pressed the centre part 1*a* of the newspaper 1 between the pair or rollers 4*a* and 5, in accordance with FIG. 4*a*, the rotatable element 7 will rotate in the direction of the arrow "Q", thereby leaving the space between the rollers 4 and 5. The perpheral speed of the tip 8*a* of the blade 8 and the speed of the tangential point between the rollers 4 and 5 should be equal to or substantially equal to the speed at which the material 1 is conveyed.

The rollers 4 and 5 are biased towards each other by means of springs (as can be seen from FIG. 9) and hence the folded part 1*a* of the newspaper will be retained by the rollers 4 and 5. When the element 7 is displaced in the direction "Q", and the plate 3 it is displaced through a corresponding distance in the direction of the arrow E, the blade 8 will leave the space between the rollers 4 and 5 and the folded part 1*a* of the newspaper will remain clamped between the rollers 4 and 5 as a result of the action of the springs. When the aforementioned displacement or rotation of the element 7 and the plate 3 takes place, the roller 5 is caused to rotate in the direction of the arrow S and the roller 4 is caused to rotate in the direction of the arrow T, these rotations feeds the newspaper between the rollers 4 and 5, downwardly in FIG. 2.

Figure 3:
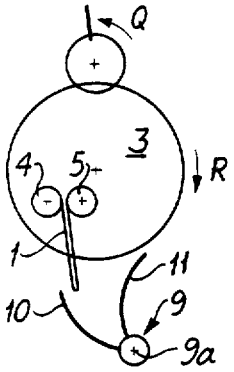

When the plate 3 has been rotated to an extent such that the rollers 4 and 5 adopt the position shown in FIG. 3, the rollers 4 and 5 will release the newspaper 1 and deliver the newspaper, folded through an angle of 180° to a depositing device 9, which in the illustrated embodiment is shown to comprise a rotatable shaft 9*a* on which a plurality of blades 10, 11 are mounted.

It should perhaps be mentioned that in the position illustrated in FIG. 3 the down-feed speed and the direction of the newspaper 1 through the rollers 4 and 5 will be compensated to a certain extent, and may also be fully compensated, by causing the rollers 4 and 5 to execute an upward movement as a result of the direction of rotation R, but to feed the folded newspaper downwardly and thereby ensure a relatively low depositing speed of the newspaper 1 to the depositing means 9.

As will be seen from FIG. 9, the rotatable element 7 is also provided with a bar 7*b* which, through a screw 7*c*, holds the blade 8 against the part 8*a* thereof facing the rotatable element 7 in firm engagement therewith. The structural design of the apparatus will now be described in more detail with reference to FIGS. 5–9. The apparatus is carried by a frame 12, 12'. A rotatable shaft 13 is rotatably mounted to the frame 12' on a bearing means 13*a*. Adjacent to the frame 12' the shaft 13 carries a gear wheel 14 which meshes with a gear wheel 15. The gear wheel 15 is mounted on a further rotatable shaft 16 which is mounted to the frame 12' through a bearing means 17. The gear wheel 14 and the gear wheel 15 have an identical number of teeth, which means that one revolution of the shaft 13 is corresponded by one revolution of the shaft 16.

It will be understood that the number of teeth can be varied in dependence upon the speed at which the shaft 16 and the blade 8 are to move relative to the speed of rotation of the plate 3, 3'. Thus, the speed distribution is dependent upon the number of blades 8 and the number or roller-pairs 4, 5 and their orientation relative to one and other. The other end of the shaft 13 is journalled in a bearing 19 incorporated in sleeve 20.

The means for driving shaft 13 and the shaft 16 do not comprise parts of the present invention and are not shown in the drawings. In this respect it is conceivable to cause the driving wheel 14 or 15 to be brought into driving engagement with a driving gear wheel (not shown), driven synchronously with the apparatus in general.

The centre part of the shaft 16 is thickened, as shown in 16*a*, a blade 8 being mounted on this thickened part of the shaft.

Thus, the aforementioned rotatable element 7 comprises substantially the shaft 16, the thickened centre part 16*a* and the bearing 17 mounted in the frame part 12' and the bearing 18 mounted in the frame part 12.

At its other end 13*b* the shaft 13 is journalled in a sleeve 20 through a bearing 19. The sleeve 20 is mounted on the frame 12 by means of screws 21 in a manner such that the sleeve 20 cannot be rotated relative to the frame 12. The inner part of the sleeve 20 exhibits a gear wheel 22, which is also shown in FIG. 4. The gear wheel 22 meshes with a gear wheel mounted on the plate and arranged to operate as an intermediate wheel for gear wheel 24.

The gear wheel 24 is attached to a body 34 arranged for rotation in the plate 3. The body 34 is mounted via bearings 34*a* and 3*b*. On the other side there is arranged a further body 35 journalled to the plate 3' via a bearing 35*a* and 35*b*. The bearings 34*a* and 35*a* are roller bearings while the bearings 34*b* and 35*b* are ball bearings.

A sleeve 50 is fastened to the plate 3 by screws 51 and 54, while a further sleeve 50' is fastened to the plate 3' by screws 51' and 52'.

Each of these sleeves 50, 50' carry a gear ring 44 and 44' and a seal 55. The sleeves are arranged to guide the rotation of the bodies 34 and 35 in respective plates 3 and 3'.

The sleeve 50 and 51' is stationary relative to the plates 3 and 3' but can be rotated about its centre line to enable correct meshing relative to the gear rings 44 and 44' and the gear wheels 45 and 45'.

The gear ring 44 is in meshing engagement with a gear wheel 45 while the gear ring 44' is in meshing engagement with a gear wheel 45'.

The gear wheels 45 and 45' are securely mounted on the shaft 25 which is journalled in the bodies 34 and 35 with needle bearings 46 and 46'.

In the illustrated embodiment, the desired rotational movement of the roller 4 and also the roller 5 is effected by causing the gear wheel 45 and 45' to wander, by rotation of the plates 3, 3', along the internal gear ring 44 and 44'. This takes place when the shaft 13 is caused to rotate, the gear wheel 24 being caused to move around the stationary gear wheel 22 via the intermediate wheel 23.

Since the gear wheels 22 and 24 have the same number of teeth, the bodies 34 and 35 will constantly rotate around their centre and adopt the same, set horizontal position via the horizontal line during a complete revolution of the shaft 13.

The horizontal setting of the rollers 4 and 5 and any deviation therefrom is effected by rotating the sleeve 20 with the gear wheel 22 mounted thereon relative to the frame 12 and to lock the sleeve 20 in the desired position by means of screws 21.

The bodies 34 and 35 are correctly positioned relative to one another in a manner such that the centre of the rollers 4 and 5 obtain a position parallel with the centre line of the shaft 13.

This is effected by the fact that the gear wheel 45, which moves along the internal circular gear ring 24, transfers its movement via the shaft 25, to the gear wheel 45', which is in constant meshing engagement with the internal circular gear ring 44' and causes the rotational body 35 to adopt a position which is exactly related to the body 34.

The roller 5 is rotated at the same speed as the roller 4 by the fact that the gear wheel 26 on the shaft 25 is in meshing engagement with a gear wheel 27 securely connected to the roller 5. The roller 5 is journalled on a non-rotatable shaft 29 through ball bearings 28 and 33. The shaft 29, the two ends 29*a* and 29*b* of which have rectangular cross section, runs in a groove formed in a slide 29*c*. The shaft 29, and therewith also the roller 5, is adjustable by means of screws 30 and 30' towards and away from the roller 4 in the slide direction of the slide 29*c*. The springs 31 and 31' urge the ends 29*a* and 29*b* of the shaft 29 into abutment with screws 30 and 30'.

The slide 29*c* is moveable in the bodies 34 and is intended, with the aid of springs 48 to be caused to adopt a position in which it can abut a fixed stop. The spring-force of the springs is directed towards the roller 4.

The nip 49 between the rollers 4 and 5 can be adjusted by means of screws 30 and 30' for the purpose of enabling a fixed presetting to be made with a wider nip between the rollers when folding thicker material than when folding thinner material.

The construction illustrated in FIG. 4*a* is shown in more detail in FIG. 9. It will be seen from FIG. 9 that the springs 48 urge the roller 5 towards the roller 4 and that the roller 5 can be urged away from the roller 4, against a spring-force, to receive the material. In addition, the rollers 4 and 5 have a speed directed towards the right corresponding to the speed of the blade 8 and the speed at which the material is conveyed.

Finally, it will be seen that the distance A between the rotational centre *7a* and the tangential point of the rollers 4 and 5 and the distance B between the tangential point and the centre of rotation of the shaft 13 are equal, owing to the fact that only one blade 8 and one roller pair 4 and 5 have been used. This distance A and B must be varied when more blades or more roller pairs 4 and 5 are used, so that the same speed is obtained for both the tip of the blade and the tangential point during their mutual co-operation.

it should be observed that the gear wheels 14 and 15 may exhibit a number or teeth which is a multiple of each other depending upon the number of blades and the number or pairs of rollers used.

It is essential that the aforementioned point "c" shown in FIG. 9 constitutes a dividing diameter or rolling-off point for the rotational bodies of the shaft 13 and 16.

Figure 5:
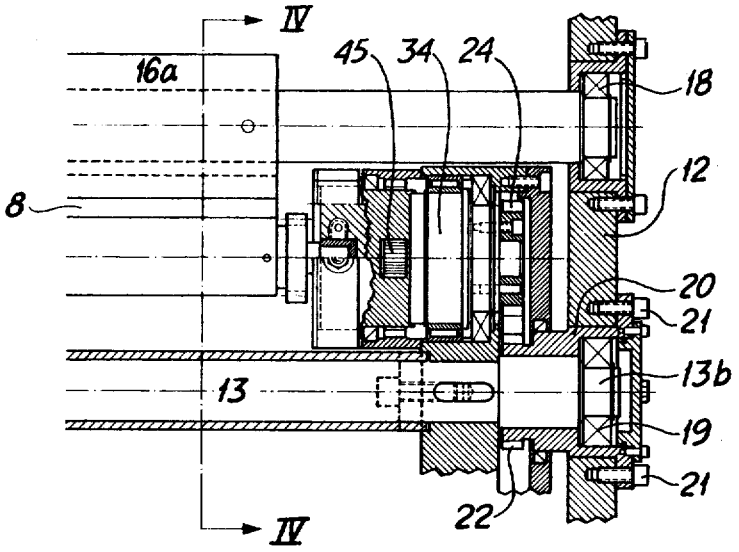
Figure 6:
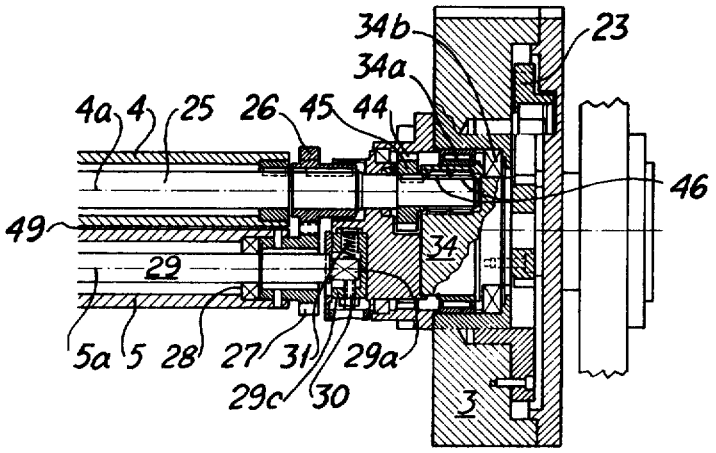
Figure 7:
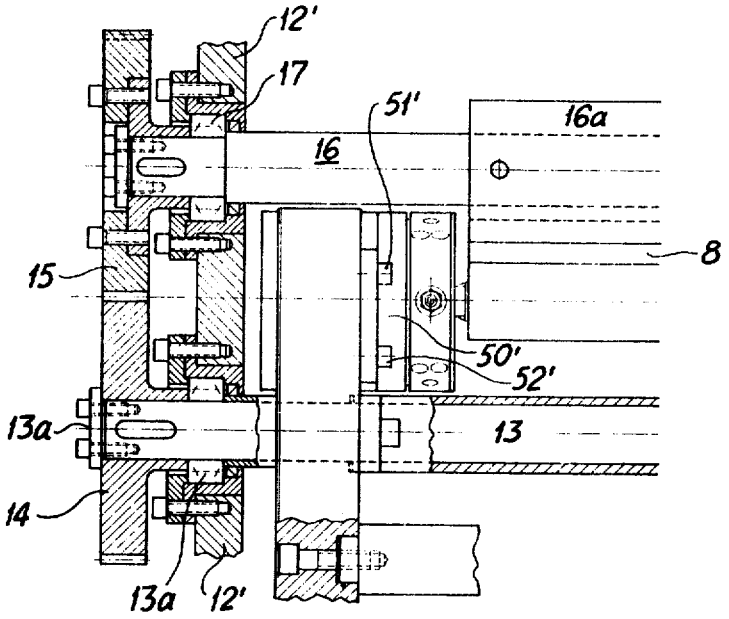
Figure 8:
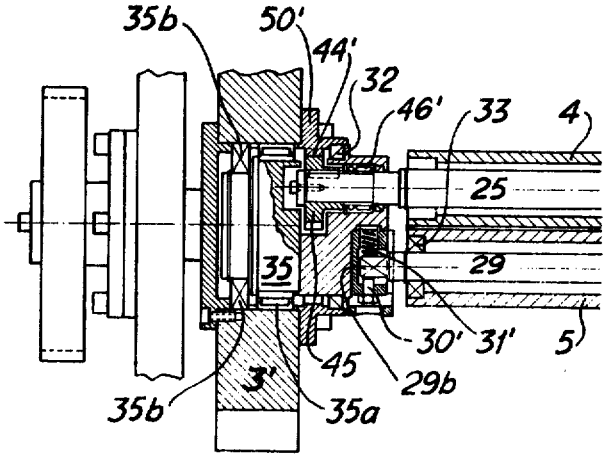
Figure 10:
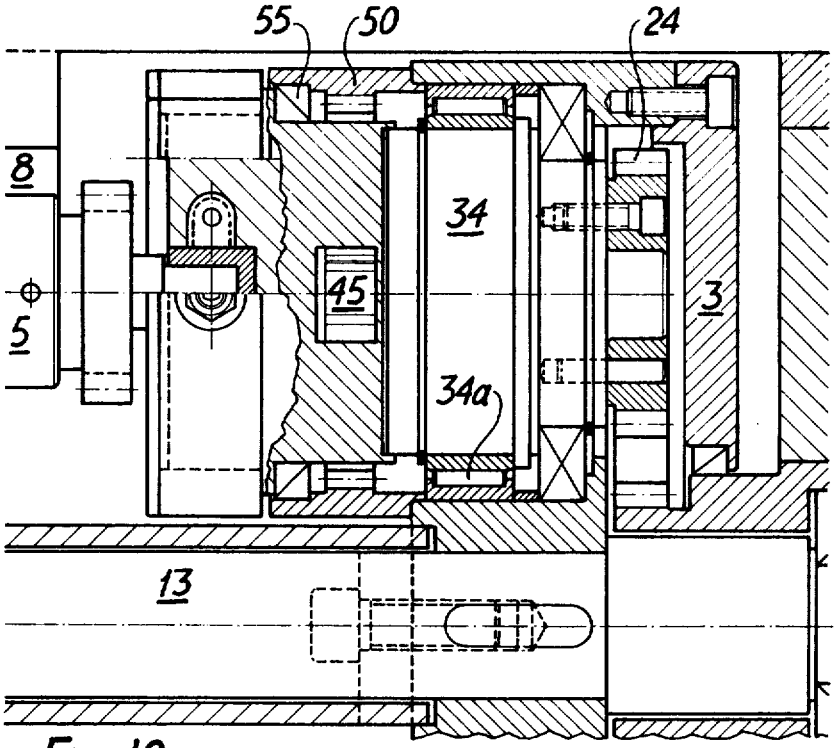
Figure 11:
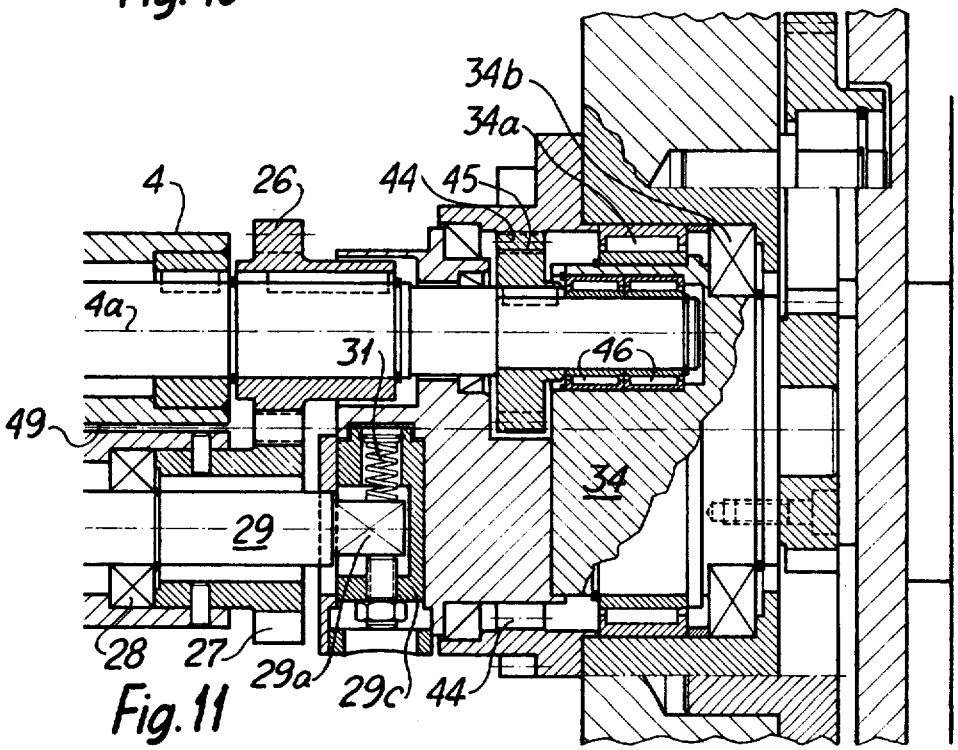

FIGS. 10 and 11 illustrate in somewhat larger scale certain of those elements shown in FIGS. 5 and 6. The invention is not limited to the described and illustrated embodiment thereof but can be modified within the scope of the accompanying claims.

What is claimed is:

1. An apparatus for folding a sheet of material through an angle of 180° by conveying the material between a rotatable element provided with at least one blade and an element for receiving the material folded by said at least one blade wherein the element for receiving the material when folded by said at least one blade comprises two rollers which are moved at a speed substantially corresponding to the conveying speed of the material, the two rollers being coupled together and arranged to be placed in a circular arcuate path, wherein a plane oriented through the axes of rotation of the two rollers constantly maintains the same angular position relative to a fixed reference plane during movement of the two rollers along the arcuate path.

2. An apparatus according to claim 1, wherein the at least one blade (8) is arranged to adopt a position between the rollers (4, 5) at a position of the rollers along the arcuate path.

3. An apparatus according to claim 1 wherein the two rollers are moved at a speed exactly corresponding to the conveying speed of the material.

4. An apparatus according to claim 1, wherein the two rollers are driven by a plurality of gear wheels and are each mounted at respective ends of two rotatable plates (3, 3').

5. An apparatus according to claim 4, wherein a shaft (13) is journalled at one end thereof through said plates in a first gear wheel (22) fixedly mounted on a frame.

6. An apparatus according to claim 5, wherein the first gear wheel (22) is in meshing engagement with a second gear wheel (23) which, in turn, is in meshing engagement with a third (24) gear wheel mounted on a body rotatably fixed in one of the plates.

7. An apparatus according to claim 6, wherein a sleeve (50, 51) mounted in said one of the plates (3) has an internally formed gear ring (44) with which a fourth gear wheel (45) mounted on one of the rollers (4) cooperates.

8. An apparatus according to claim 6, wherein each of the rollers (4, 5) is mounted on a respective body (34, 35) in a respective plate (3, 3').

9. An apparatus according to claim 5, wherein the shaft extending through the plates (13) carries a second gear wheel (14) which is in meshing engagement with a third gear wheel (15) mounted on a rotatable shaft (16) for the blade (8).

10. An apparatus according to claim 9, wherein one of the second and third gear wheels has a number of teeth corresponding to a multiple of the other gear wheel.

11. An apparatus according to claim 1, wherein one of the rollers comprises a sleeve (5) mounted for rotation on a shaft (2) which is adjustable (30, 31) towards and away from the other of said rollers.

12. An apparatus according to claim 11, wherein the sleeve (5) is biased by springs (48) towards the other of said rollers (4).

13. An apparatus according to claim 1, wherein the two rollers (4, 5) are in meshing engagement (26, 27) with each other.

* * * * *